US009792813B2

(12) United States Patent
Colonna

(10) Patent No.: US 9,792,813 B2
(45) Date of Patent: Oct. 17, 2017

(54) MANAGEMENT OF DATA COLLECTED FOR TRAFFIC ANALYSIS

(71) Applicant: TELECOM ITALIA S.p.A., Milan (IT)

(72) Inventor: Massimo Colonna, Turin (IT)

(73) Assignee: TELECOM ITALIA S.p.A., Milan (IT)

( * ) Notice: Subject to any disclaimer, the term of this patent is extended or adjusted under 35 U.S.C. 154(b) by 0 days.

(21) Appl. No.: 14/910,969

(22) PCT Filed: Aug. 8, 2013

(86) PCT No.: PCT/EP2013/066605
§ 371 (c)(1),
(2) Date: Feb. 8, 2016

(87) PCT Pub. No.: WO2015/018445
PCT Pub. Date: Feb. 12, 2015

(65) Prior Publication Data

US 2016/0203713 A1 Jul. 14, 2016

(51) Int. Cl.
*G08G 1/01* (2006.01)

(52) U.S. Cl.
CPC ..... *G08G 1/0125* (2013.01); *G08G 1/0112* (2013.01); *G08G 1/0133* (2013.01)

(58) Field of Classification Search
CPC ... G08G 1/0125; G08G 1/0133; G08G 1/0112
USPC ..... 701/117
See application file for complete search history.

(56) References Cited

U.S. PATENT DOCUMENTS

2013/0035089 A1 2/2013 Moritz et al.

FOREIGN PATENT DOCUMENTS

WO 2007/031370 A2 3/2007

OTHER PUBLICATIONS

International Search Report and Written Opinion of the International Searching Authority dated Jun. 4, 2014 in PCT/EP13/066605 Filed Aug. 8, 2013.

*Primary Examiner* — Brian P Sweeney
(74) *Attorney, Agent, or Firm* — Oblon, McClelland, Maier & Neustadt, L.L.P.

(57) ABSTRACT

A method for managing data regarding one or more flows of physical entities in a geographic area during at least one predetermined time period. For each physical entity, the data includes a plurality of positioning data representing detected positions of the element in the geographic area and corresponding time data identifying instants at which each position is detected. The method subdivides the geographic area into at least two zones, subdivides the at least one time period into one or more time slots, and identifies a number of physical entities that flowed from a first zone of the at least two zones to a second zone of the at least two zones during each time slot.

14 Claims, 9 Drawing Sheets

200

| | $z_1$ | $z_2$ | … | $z_j$ | … | $z_8$ | $z_9$ |
|---|---|---|---|---|---|---|---|
| $z_1$ | od(1,1) | od(1,2) | | od(1,j) | | od(1,8) | od(1,9) |
| $z_2$ | od(1,2) | od(2,2) | | od(2,j) | | od(2,8) | od(2,9) |
| … | | | | … | | | … |
| $z_i$ | od(i,1) | od(i,2) | | od(i,j) | … | od(i,8) | od(i,9) |
| … | | | | … | | | … |
| $z_8$ | od(1,8) | od(8,2) | | od(8,j) | | od(8,8) | od(8,9) |
| $z_9$ | od(1,9) | od(9,2) | … | od(9,j) | … | od(9,8) | od(9,9) |

FIG.2

MANAGEMENT OF DATA COLLECTED FOR TRAFFIC ANALYSIS

BACKGROUND

Field of the Invention

The solution according to the present invention relates to analysis of traffic flows of moving physical entities. In detail, the solution according to the present invention relates to management of empirical data collected for performing traffic analysis.

Overview of the Related Art

Traffic analysis is aimed at identifying and predicting variations in the flow (e.g., vehicular traffic flow) of physical entities (e.g., land vehicles) moving in a geographic area of interest (e.g., a urban area) and over a predetermined observation period (e.g., a 24 hours observation period).

A typical, but not limitative, example of traffic analysis is represented by the analysis of vehicular (cars, trucks, etc.) traffic flow over the routes of a geographic area of interest. Such analysis allows achieving a more efficient planning of the transportation infrastructure within the area of interest and also it allows predicting how changes in the transportation infrastructure, such as for example closure of roads, changes in a sequencing of traffic lights, construction of new roads and new buildings, can impact on the vehicular traffic.

In the following for traffic analysis it is intended the analysis of the movements of physical entities through a geographic area. Such physical entities can be vehicles (e.g., cars, trucks, motorcycles, public transportation buses) and/or individuals.

Since it is based on statistical calculations, traffic analysis needs a large amount of empirical data to be collected in respect of the area of interest and the selected observation period, in order to provide accurate results. In order to perform the analysis of traffic, the collected empirical data are then usually arranged in a plurality of matrices, known in the art as Origin-Destination (O-D) matrices. The O-D matrices are based upon a partitioning of both the area of interest and the observation period.

For partitioning the area of interest, the area is subdivided into a plurality of zones, each zone being defined according to several parameters such as for example, authorities in charge of the administration of the zones (e.g., a municipality), typology of land lots in the area of interest (such as open space, residential, agricultural, commercial or industrial lots) and physical barriers (e.g., rivers) that can hinder traffic (physical barriers can be used as zone boundaries). The size of the zones in which the area of interest can be subdivided, and consequently the number of zones, is proportional to the level of detail requested for the traffic analysis (i.e., city districts level, city level, regional level, state level, etc.).

As well, the observation period can be subdivided into one or more time slots, each time slot being defined according to known traffic trends, such as for example peak traffic hours corresponding to when most commuters travel to their workplace and/or travel back to home. The length of the time slots (and thus their number) is proportional to the level of detail requested for the traffic analysis over the considered observation period.

Each entry of a generic O-D matrix comprises the number of physical entities moving from a first zone (origin) to a second zone (destination) of the area of interest. Each O-D matrix corresponds to one time slot out of the one or more time slots in which the considered observation period can be subdivided. In order to obtain a reliable traffic analysis, sets of O-D matrices should be computed over a plurality of analogous observation periods and should be combined so as to obtain O-D matrices with a higher statistical value. For example, empirical data regarding the movements of physical entities should be collected over a number of consecutive days (each corresponding to a different observation period), and for each day a corresponding set of O-D matrices should be computed.

A typical method for collecting empirical data used to compute O-D matrices related to a specific area of interest is based on submitting questionnaires to, or performing interviews with inhabitants of the area of interest and/or to inhabitants of the neighboring areas about their habits in relation to their movements, and/or by installing vehicle count stations along routes of the area of interest for counting the number of vehicles moving along such routes. The Applicant has observed that this method has very high costs and it requires a long time for collecting a sufficient amount of empirical data. Due to this, O-D matrices used to perform traffic analysis are built seldom, possibly every several years, and become out-of-date.

In the art, several alternative solutions have been proposed for collecting empirical data used to compute O-D matrices.

For example, U.S. Pat. No. 5,402,117 discloses a method for collecting mobility data in which, via a cellular radio communication system, measured values are transmitted from vehicles to a computer. The measured values are chosen so that they can be used to determine O-D matrices without infringing upon the privacy of the users.

In Chinese Patent Application No. 102013159 a number plate identification data-based area dynamic origin and destination (OD) data acquiring method is described. The dynamic OD data is the dynamic origin and destination data, wherein O represents origin and D represents destination. The method comprises the steps of: dividing OD areas according to requirements, wherein the minimum time unit is 5 minutes; uniformly processing data of each intersection in the area every 15 minutes by a traffic control center; detecting number plate data; packing the number plate identification data; uploading the number plate identification data to the traffic control center; comparing a plate number with an identity (ID) number passing through the intersections; acquiring the time of each vehicle passing through each intersection; acquiring the number of each intersection in the path through which each vehicle passes from the O point to the D point by taking the plate number as a clue; sequencing the intersections according to time sequence and according to the number of the vehicles which pass through between the nodes calculating a dynamic OD data matrix.

WO 2007/031370 relates to a method for automatically acquiring traffic inquiry data, e.g. in the form of an O-D matrix, especially as input information for traffic control systems. The traffic inquiry data are collected by means of radio devices placed along the available routes.

Nowadays, mobile phones have reached a thorough diffusion among the population of many countries, and mobile phone owners almost always carry their mobile phone with them. Since mobile phones communicates with a plurality of base stations of the mobile phone networks, and each base station operates over a predetermined geographic area (or cell) which is known to the mobile phone network, mobile phones result to be optimal candidates as tracking devices for collecting data useful for performing traffic analysis. For example, N. Caceres, J. Wideberg, and F. Benitez "Deriving origin destination data from a mobile phone network", Intelligent Transport Systems, IET, vol. 1, no. 1, pp. 15-26, 2007, describes a mobility analysis simulation of moving vehicles along a highway covered by a plurality of GSM network cells. In the simulation the entries of O-D matrices are determined by identifying the GSM cells used by the mobile phones in the moving vehicles for establishing voice calls or sending sms.

US 2006/0293046 proposes a method for exploiting data from a wireless telephony network to support traffic analysis. Data related to wireless network users are extracted from the wireless network to determine the location of a mobile station. Additional location records for the mobile station can be used to characterize the movement of the mobile station: its speed, its route, its point of origin and destination, and its primary and secondary transportation analysis zones. Aggregating data associated with multiple mobile stations allows characterizing and predicting traffic parameters, including traffic speeds and volumes along routes.

In F. Calabrese et al. "Estimating Origin-Destination Flows Using Mobile Phone Location Data", IEEE Pervasive, pp. 36-44, October-December 2011 (vol. 10 no. 4), a further method is proposed that envisages to analyze position variations of mobile devices in a respective mobile communication network in order to determine entries of O-D matrices.

SUMMARY OF THE INVENTION

The Applicant has perceived a general lack of manageability in the use of the large amount of empirical data collected by means of the systems and methods known in the art in order to perform a traffic analysis in a specific area of interest.

In particular, the Applicant has observed that generally, using mobile phones of a mobile phone network as tracking devices results in obtaining a very large amount of empirical data, not all of which are useful for the purpose of performing a traffic analysis. Therefore, in order to compute the O-D matrices that are then used to perform the traffic analysis, the vast amount of empirical data that are provided by the mobile phone network has to be thoroughly analyzed and submitted to heavy processing (operations that are both time and resources consuming).

In fact, the data provided by the mobile phone network correspond to every interaction between every mobile phone and the mobile phone network, like for example the setting up of calls, the sending or reception of text messages (SMS), exchange of data, irrespective of whether the mobile phones have actually changed their geographic locations. Therefore, in order to build the O-D matrices, the data provided by the mobile phone network have to be scanned and filtered out to derive information about the actual movement of mobile phones.

Furthermore, the data provided by the mobile phone network give the position of the mobile phones in the mobile phone network in terms of mobile phone network cells to which the mobile phones are connected. The cells, generally, do not correspond to the traffic analysis zones in the geographic area of interest: for example, the mobile phone network cells are by far smaller than the traffic analysis zones.

Therefore, in order to build the O-D matrices, the data provided by the mobile phone network need to be processed to identify a correspondence between groups of cells of the mobile phone network and respective traffic analysis zones of the geographic area of interest.

Moreover, the data provided by the mobile phone network have to be analyzed and aggregated in the time domain to correspond to the traffic analysis time slots.

Only after such operations it is possible to compose correct O-D matrices.

The Applicant has therefore tackled the problem of how to manage, in an efficient way, the large amount of empirical data provided by a mobile phone network for computing in a fast and reliable way possibly distinct sets of O-D matrices, corresponding to different partitions into zones and/or time slots of a specific area of interest and of an observation time period, in such a way to allow traffic analysis having a customizable accuracy and/or precision (according to desired levels of detail).

The Applicant has found that by collecting and aggregating empirical data having a finer granularity (in terms of smaller size of the zones into which the geographic area of interest is partitioned and/or shorter length of the time slots into which the observation period is subdivided) than the granularity that is expected to be required for subsequently performing traffic analysis, a more efficient managing of the empirical data and a more efficient and faster computation of different sets of O-D matrices related to different levels of detail of the traffic analysis is made possible.

Particularly, one aspect of the present invention proposes a method for managing data regarding one or more flows of physical entities in a geographic area during at least one predetermined time period. For each physical entity, the data comprise a plurality of positioning data representing detected positions of the element in said geographic area and corresponding time data identifying instants at which each position is detected. The method comprises the following steps. Subdividing the geographic area into at least two zones. Subdividing the at least one time period into one or more time slots. Identifying a number of physical entities that flowed from a first zone of the at least two zones to a second zone of the at least two zones during each time slot. Computing an Origin-Destination matrix for each time slot of the one or more time slots based on such identifying, each Origin-Destination matrix comprising a respective row for each one of the at least two zones where the flow of the physical entities may have started and a respective column for each one of the at least two zones where the flow of the physical entities may have ended during the corresponding time slot, and each entry of the Origin-Destination matrix being indicative of the number of physical entities that, during the corresponding time slot, flowed from a first zone of the at least two zones to a second zone. In the solution according to an embodiment of the present invention, the method further comprises the following steps. Subdividing the geographic area into a plurality of basic zones. Subdividing the at least one time period into a plurality of basic time slots, wherein said basic zones are smaller than said zones, and/or said basic time slots are shorter than the one or more time slots. Identifying a further number of elements flowed from a first basic zone of the plurality of basic zones to a second basic zone of the plurality of basic zones during each basic time slot. Computing a basic Origin-Destination matrix for each basic time slot on the base of such identifying, each basic origin-destination matrix comprising a respective row for each one of the plurality of basic zones where elements flow may have started and a respective column for each one of the plurality of basic zones where elements flow may have ended during the corresponding basic time slot, and each entry of the basic Origin-Destination matrix comprises the further number of elements flowed from a first basic zone of the plurality of basic zones to a second basic zone of the plurality of basic zones. Moreover, the step of identifying a number of elements flowed from a first zone to a second zone during each time slot comprises:

combining together a selected subset of basic Origin-Destination matrices for each Origin-Destination matrix, and combining together selected subsets of entries in each combined subset of basic Origin-Destination matrices, or combining together selected subsets of entries in each basic Origin-Destination matrix, and combining together a selected subset of basic Origin-Destination matrices having combined selected subsets of entries for each Origin-Destination matrix.

Preferred features of the present invention are set in the dependent claims.

In one embodiment of the present invention, the step of identifying a number of elements flowed from a first zone to a second zone during for each time slot of the one or more time slots comprises: selecting a subset of basic time slots comprised in the time slot, and selecting a subset of basic zones comprised in the zone.

In a further embodiment of the present invention, the step of selecting a subset of basic zones comprised in the zone comprises: selecting a basic zone if a selected percentage of an area of said basic zone is comprised in the zone.

In one embodiment of the present invention each basic zone of the plurality of basic zones comprises a centroid representing a hub for the flows of elements in said basic zone, and wherein the step of selecting a subset of basic zones comprised in the zone comprises selecting a basic zone if the centroid of said basic zone is comprised in the zone.

In a further embodiment of the present invention, the step of combining together a selected subset of basic Origin-Destination matrices for each Origin-Destination matrix comprises computing a transitional Origin-Destination matrix for each time slot by combining a subset of basic Origin-Destination matrices, each corresponding to a selected basic time slot of the selected subset of basic time slots, each transitional Origin-Destination matrix comprising a respective row for each one of the plurality of basic zones where elements flow may have started and a respective column for each one of the plurality of basic zones where elements flow may have ended during the corresponding time slot, and each entry of the transitional Origin-Destination matrix comprises a number of elements flowed from a first basic zone of the plurality of basic zones to a second basic zone of the plurality of basic zones during the corresponding time slot.

In one embodiment of the present invention, the step of computing a Origin-Destination matrix for each time slot further comprises combining together a subset of entries of the transitional Origin-Destination matrix, each corresponding to a selected basic zone of the subset of basic zones.

In a further embodiment of the present invention, the step of combining together selected subsets of entries in each basic Origin-Destination matrix comprises computing a transitional Origin-Destination matrix for each basic time slot by combining a selected subsets of entries of the corresponding basic Origin-Destination matrix, each transitional Origin-Destination matrix comprising a respective row for each one of the plurality of zones where elements flow may have started and a respective column for each one of the plurality of zones where elements flow may have ended during the corresponding time slot, and each entry of the transitional Origin-Destination matrix comprises a number of elements flowed from a first zone of the at least two zones to a second zone of the at least two zones during the corresponding basic time slot.

In one embodiment of the present invention, the step of computing a Origin-Destination matrix for each time slot further comprises combining together a subset of transitional Origin-Destination matrix, each corresponding to a selected basic time slot of the selected subset of basic time slots.

In a further embodiment of the present invention, the method further comprising the steps of modifying parameters used for subdividing the geographic area into a plurality of basic zones and/or the at least one time period into a plurality of basic time slots, according to a user request. Moreover, the method further comprising reiterating the step of subdividing the geographic area into a plurality of basic zones smaller than the zones, and/or subdividing the at least one time period into a plurality of basic time slots, said basic time slots being shorter than the time slots, according to the modified parameters. Furthermore, the method comprises reiterating the steps of identifying a further number of elements flowed from a first basic zone of the plurality of basic zones to a second basic zone of the plurality of basic zones during each basic time slot, and computing a basic Origin-Destination matrix for each basic time slot on the base of such identifying.

In one embodiment of the present invention, the method further comprising the step of modifying parameters used for subdividing the geographic area into a plurality of zones and/or the at least one time period into one or more time slots, according to a user request. Moreover, the method further comprises reiterating the following steps. Subdividing the geographic area into at least two zones. Subdividing the at least one time period into one or more time slots. Identifying a number of elements flowed from a first zone of the at least two zones to a second zone of the at least two zones during each time slot. Computing an Origin-Destination matrix for each time slot of the one or more time slots on the base of such identifying.

In a further embodiment of the present invention, a radio-telecommunication network operating over a plurality of telecommunication cells is deployed in the geographic area, and the managed data regard one or more mobile telecommunication devices each mobile telecommunication device being associated with a respective one of the flowing elements. The step of subdividing the geographic area into a plurality of basic zones comprises associating each basic zone of the plurality of basic zones with at least a corresponding telecommunication cell of the radio-telecommunication network.

Another aspect of the present invention proposes a system for managing data regarding one or more flows of elements in a geographic area during at least one predetermined time period, wherein a radio-telecommunication network subdivided into a plurality of telecommunication cells is deployed in said geographic area. The system comprises a storage element adapted to store data comprising a plurality of positioning data representing a detected positions of the element in said geographic area and corresponding time data identifying instants at which each position is detected, a computation engine adapted to compute at least a matrix based on data stored in the repository by implementing the method.

In one embodiment of the present invention, the storage element is further adapted to store the at least one matrix computed by the computation engine.

In a further embodiment of the present invention, the system further comprises at least one user interface adapted to output information to, and receiving inputs information from, at least one user.

In one embodiment of the present invention, the system is further adapted to collect data regarding a plurality of mobile telecommunication devices comprised in the area of interest, each mobile telecommunication device being associated with a respective one of the flowing elements in the area of interest.

BRIEF DESCRIPTION OF THE DRAWINGS

These, and others, features and advantages of the solution according to the present invention will be better understood by reading the following detailed description of an embodiment thereof, provided merely by way of non-limitative example, to be read in conjunction with the attached drawings and claims, wherein:

FIG. 2 shows a generic O-D matrix related to the geographic area of interest of FIG. 1, corresponding to a certain time slot of an observation period;

DETAILED DESCRIPTION OF AN EMBODIMENT OF THE INVENTION

Figure 1:
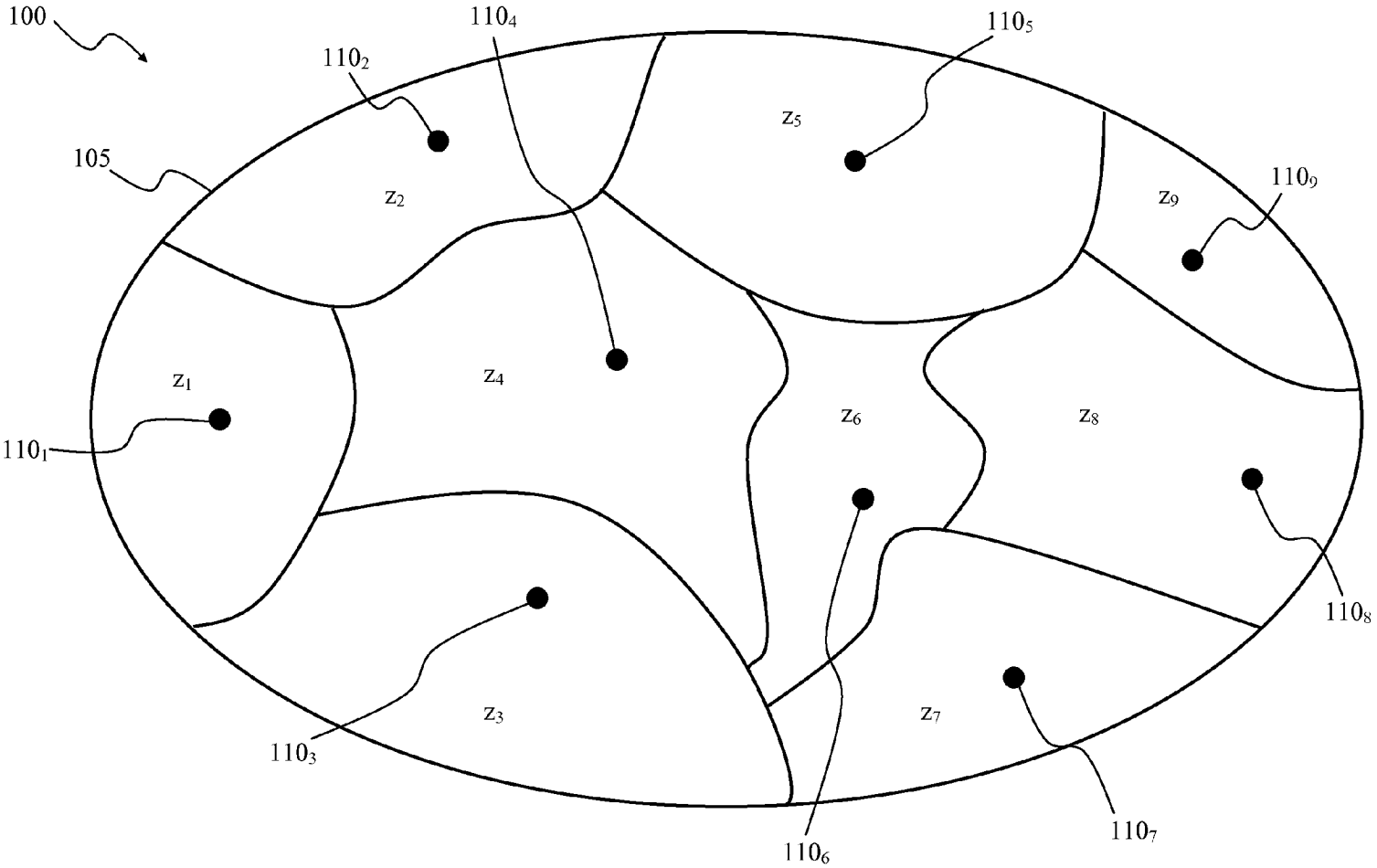
FIG. 1 is a schematic view of a geographic area of interest for performing a traffic analysis of physical entities (e.g., vehicles), the geographic area of interest being subdivided into a plurality of zones.

With reference to the drawings, FIG. 1 is a schematic view of a geographic area of interest 100 (in the following simply denoted as area of interest).

The area of interest 100 is a selected geographic region within which a traffic analysis should be performed according to an embodiment of the present invention. For example, the area of interest 100 may be either a district, a town, a city, or any other kind of geographic area. Let be assumed, as non-limiting example, that a traffic analysis (e.g., an analysis of vehicular traffic flow) over the area of interest 100 should be performed.

The area of interest 100 is delimited by a boundary, or external cordon 105. The area of interest 100 is subdivided into a plurality of traffic analysis zones, or simply zones $z_n$ (n=1, . . . , N; where N is an integer number, and N>0) in which it is desired to analyze traffic flows. In the example shown in FIG. 1, the area of interest 100 is subdivided into nine zones $z_1, \ldots, z_9$ (i.e., N=9).

Each zone $z_n$ may be advantageously determined by using the already described zoning technique. According to this technique, each zone $z_n$ may be delimited by physical barriers (such as rivers, railroads etc.) within the area of interest 100 that may hinder the traffic flow and may comprise adjacent lots of a same kind (such as open space, residential, agricultural, commercial or industrial lots) which are expected to experience similar traffic flows. It should be noted that the zones $z_n$ may differ in size one another. Generally, each zone $z_n$ is modeled as if all traffic flows starting or ending therein were concentrated in a respective single point or centroid $\mathbf{110}_n$ (i.e., $\mathbf{110}_1, \ldots, \mathbf{110}_9$). In other words, the centroid $\mathbf{110}_n$ of the generic zone $z_n$ represents an ideal hub from or at which any traffic flow starts or ends, respectively.

Anyway, it is pointed out that the solution according to embodiments of the present invention is independent from the criteria used to partition the area of interest 100 into zones.

Considering now FIG. 2, an O-D matrix 200 corresponding to the area of interest 100 is depicted. The O-D matrix 200 is referred to a respective time interval or time slot of an observation time period, as described in greater detail in the following.

The generic O-D matrix 200 is typically a square matrix having N rows i and N columns j. Each row and each column are associated with a corresponding zone $z_n$ of the area of interest 100; thus, in the example of FIG. 1, the O-D matrix 200 comprises nine rows i=1, . . . , 9 and nine columns j=1, . . . , 9.

Each row i represents an origin zone $z_i$ for traffic flows of moving physical entities (for example land vehicles) while each column j represent a destination zone $z_j$ for traffic flows of such moving physical entities. In other words, each generic element or entry $od_{(i,j)}$ of the O-D matrix 200 represents the number of traffic flows starting in the zone $z_i$ (origin zone) and ending in the zone $z_j$ (destination zone) in the corresponding time slot.

The main diagonal of the O-D matrix 200, which comprises the entries $od_{(i,j)}$ having i=j (i.e., entries $od_{(i,j)}$ having the same zone $z_n$ both as origin and destination zone), is usually left empty (e.g., with values set to 0) or the values of the main diagonal entries $od_{(i,j)}$ are discarded since they do not depict a movement between zones of the area of interest (i.e., such entries do not depict a traffic flow).

As known, traffic flow is strongly time-dependent. For example, during a day the traffic flow is typically more dense during morning/evening hours in which most commuters travels towards their workplace or back home than during late night hours. Therefore, the value of the entries $od_{(i,j)}$ of the O-D matrix 200 are strongly dependent on the time at which traffic data are collected.

In order to obtain a detailed and reliable traffic analysis, a predetermined observation period of the traffic flows in the area of interest is also established, e.g. the observation period corresponds to one day (24 hours) and it is subdivided into one or more (preferably a plurality) of time slots $ts_k$ (k=1, . . . , K, where K is an integer number, and K>0). Each time slot $ts_k$ ranges from an initial instant $t_0(k)$ to a next instant $t_0(k+1)$ (excluded) which is the initial instant of the next time slot $ts_{k+1}$, or:

$$ts_k=[t_0(k), t_0(k+1)).$$

Anyway, embodiments of the present invention featuring overlapping time slots are not excluded. Also, the time slots $ts_k$ into which the observation period is subdivided may have different lengths from one another.

In the considered example, the 24 hours observation period has been subdivided into seven time slots $ts_k$ (i.e., K=7). Advantageously, each time slot $ts_k$ has a respective length that is inversely proportional to an expected traffic intensity in that time slot $ts_k$ (e.g., the expected traffic density may be based on previous traffic analysis or estimation). For example, time slots having low expected traffic intensity can be set to be 6 hours long, time slots having mid expected traffic intensity can be set to be 4 hours long and time slots having high expected traffic intensity can be set to be 2 hours long; therefore, in the considered example the observation period of e.g. 24 hours has been subdivided into seven time slots $ts_k$ in the following way: $ts_1$=[00:00, 06:00), $ts_2$=[06:00, 08:00), $ts_3$=[08:00, 12:00), $ts_4$=[12:00, 14:00), $ts_5$=[14:00, 18:00), $ts_6$=[18:00, 20:00) and $ts_7$=[20:00, 24:00).

Anyway, it is pointed out that the solution according to embodiments of the present invention is independent from criteria applied for partitioning the observation period into time slots.

Figure 3:
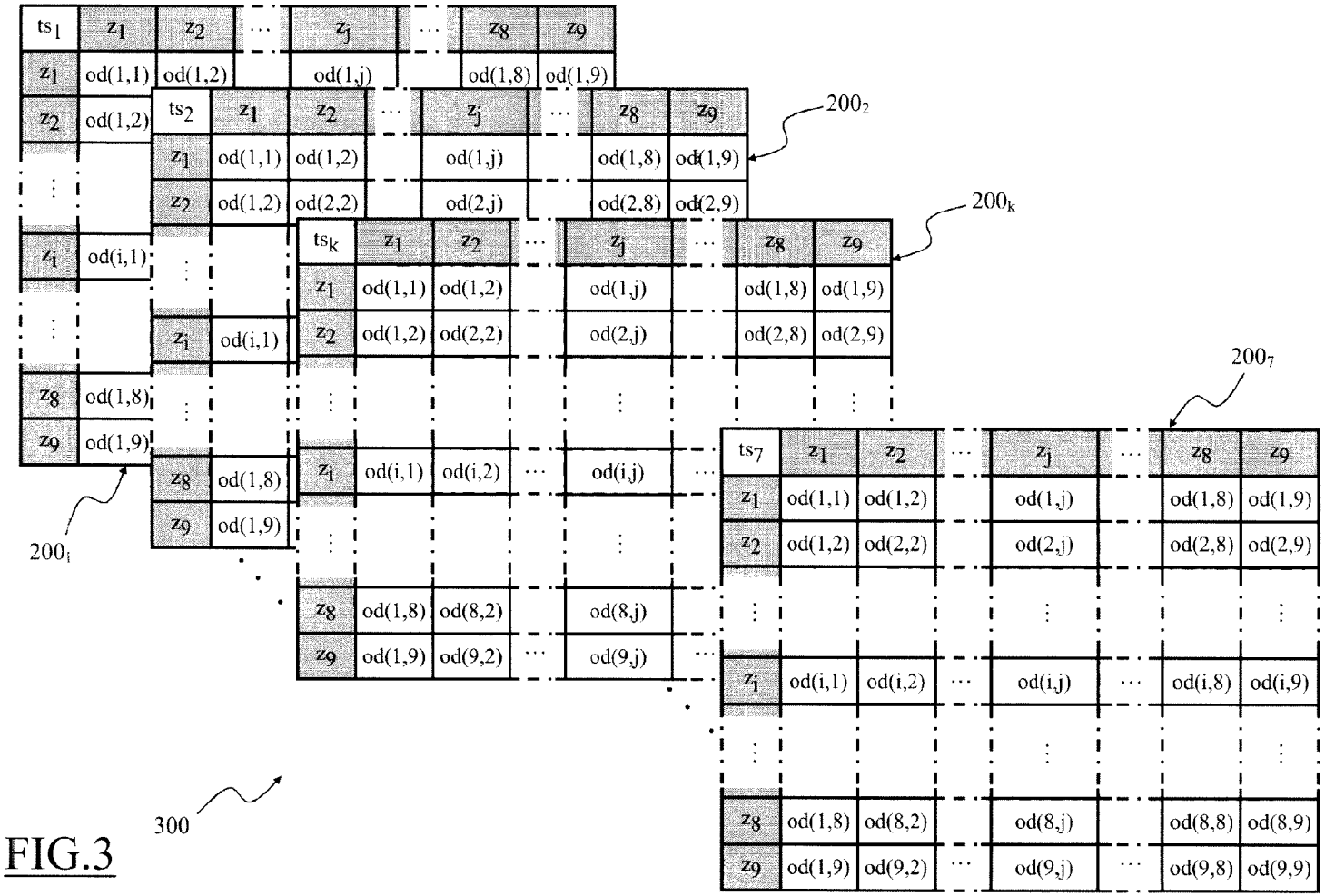
FIG. 3 shows a set of O-D matrices, related to the geographic area of interest of FIG. 1, corresponding to a respective plurality of time slots making up the observation period, and used for performing the traffic analysis.

Considering FIG. 3, showing a set 300 of O-D matrices 200 of the type of FIG. 2 referred to the area of interest 100, wherein any one of the O-D matrices $\mathbf{200}_k$ of the set 300 is calculated for a corresponding time slot $ts_k$ of the plurality of time slots into which the observation period has been subdivided.

In other words, the set 300 of O-D matrices $\mathbf{200}_k$, which generally comprises a number K of O-D matrices $\mathbf{200}_k$, each one corresponding to a respective one of the plurality of time slots into which the observation period has been subdivided, in the considered example comprises seven (i.e., K=7) O-D matrices $\mathbf{200}_1$-$\mathbf{200}_7$, each one referred to a corresponding one of the K time slot $ts_1$-$ts_7$.

In order to obtain a reliable traffic flow analysis, traffic data are usually collected over a plurality of observation periods p (p=1, P; where P is an integer number, and P>0), for example a plurality of 24-hour observation periods, so as to obtain a number p (p=1, . . . , P) of different sets 300 of O-D matrices $\mathbf{200}_k$, each one of said different sets 300 of O-D matrices $\mathbf{200}_k$ corresponding to a respective observation period p of the plurality of observation periods p=1, . . . , P. Subsequently, the O-D matrices $\mathbf{200}_k$ of each set 300 are statistically handled for computing an averaged set of O-D matrices $\mathbf{200}_k$ in which preferably, although not limitatively, the generic entry $od_{(i,j)}$ of the generic O-D matrix $\mathbf{200}_k$ contains an average value computed from the P values of the corresponding entries $od_{(i,j)}$ of all of the P O-D matrices $\mathbf{200}_k$ computed for the same time slot $ts_k$ in each of the P observation periods.

In the following, for the sake of simplicity, only one single set 300 of O-D matrices $\mathbf{200}_k$ corresponding to one single observation period p (i.e., p=P=1) will be considered, although the solution according to embodiments of the present invention may be applied to flow analysis featuring any number of observation periods p.

Figure 4:
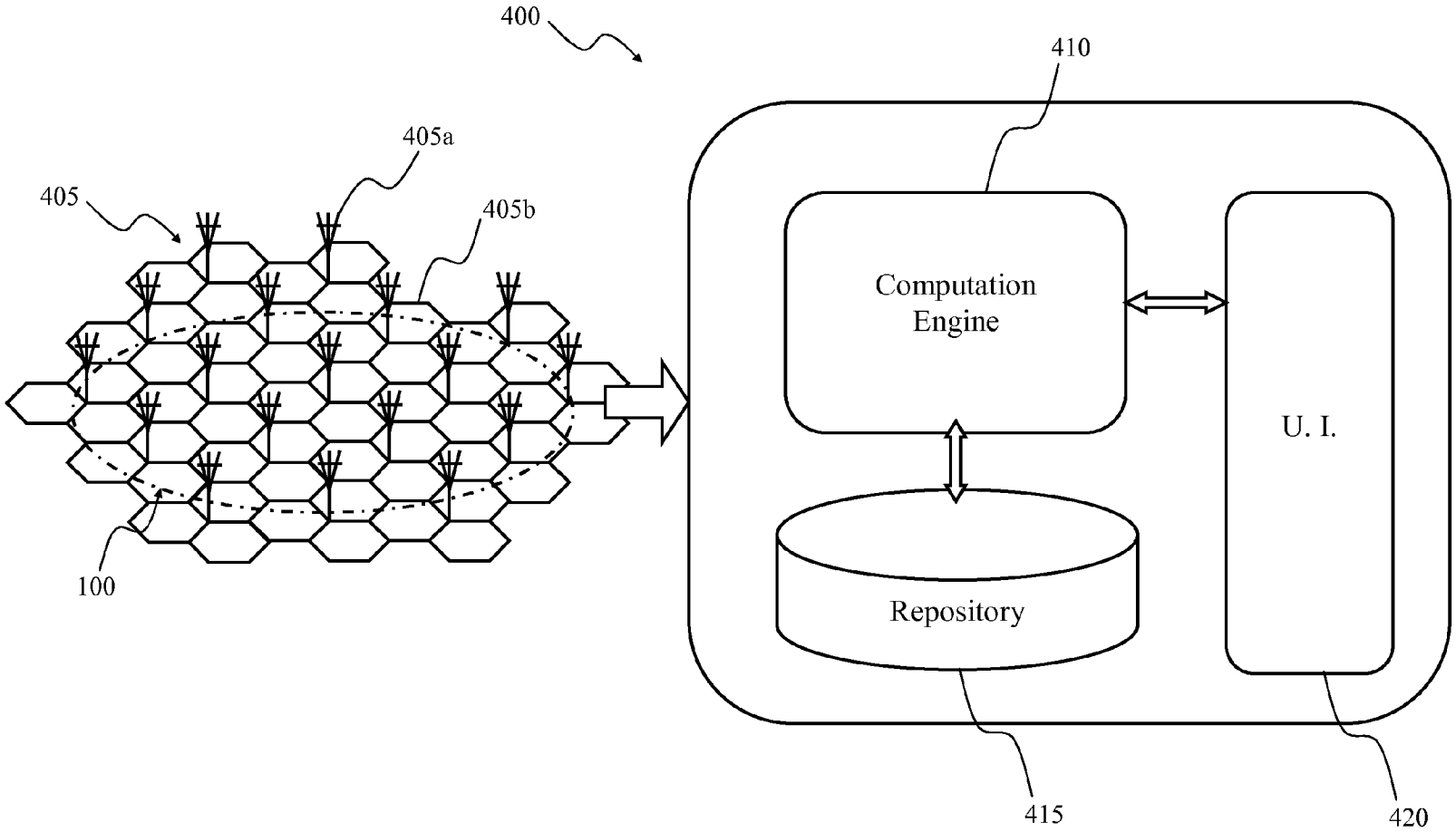
FIG. 4 is a schematic functional block diagram of a system for computing the O-D matrices of the set shown in FIG. 3, according to an embodiment of the present invention.

Turning now to FIG. 4, a system 400 according to an embodiment of the present invention is schematized for computing the O-D matrices $\mathbf{200}_k$ of the set 300.

The system 400 is connected to a communication network, such as a mobile telephony network 405, and is configured for receiving positioning data of each communication device of a physical entity (e.g., a mobile phone of an individual within a vehicle) located in the area of interest 100. For example the mobile network 405 comprises a plurality of base stations 405*a*, each adapted to manage communications of mobile phones over one or more cells 405*b* (three cells in the example at issue). Positioning data may be collected anytime the mobile phone interacts with any base station 405*a* of the mobile network 405 (e.g., at power on/off, location area update, incoming/outgoing calls, sent/received SMS and/or MMS, Internet access etc.) in the area of interest 100 during the observation period.

The system 400 comprises a computation engine 410 adapted to compute the O-D matrices $\mathbf{200}_k$, a repository 415 (such as a database, a file system, etc.) adapted to store data (such as the positioning data mentioned above). In addition, the repository 415 may be adapted to store also O-D matrices $\mathbf{200}_k$. Preferably, but not limitatively, the system 400 comprises one or more user interfaces 420 (e.g., a user terminal) adapted to receive inputs from, and to provide as output the O-D matrices $\mathbf{200}_k$ to, the user. It should be appreciated that the system 400 may be provided in any known manner; for example, the system 400 may comprise a single computer, or a distributed network of computers, either physical (e.g., with one or more main machines implementing the computation engine 410 and the repository 415 connected to other machines implementing user interfaces 420) or virtual (e.g., by implementing one or more virtual machines in a computers network).

In operation, the detected positioning data are associated with respective timing data (i.e., the time instants at which the positioning data are detected) and stored in the repository 415. The positioning and timing data are processed by the computation engine 410, which calculates each O-D matrix $\mathbf{200}_k$ of the set 300, as will be described in the following.

Finally, the set 300 of O-D matrices $\mathbf{200}_k$ is made accessible to the user through the user interface 420, and the user can perform the analysis of the traffic flows using the O-D matrices $\mathbf{200}_k$.

In the solution according to an embodiment of the present invention, the system 400 is adapted to allow the user modifying parameters (such as a number and/or a size of zones $z_n$, and/or a number and/or a duration of time slots $ts_k$, etc.) used for computing each O-D matrix $\mathbf{200}_k$, and causing the computation engine 410 to compute different sets 300 of O-D matrices $\mathbf{200}_k$ according to the modified parameters in a fast and reliable way and without the need for re-collecting and/or re-analyzing the traffic data.

Figure 5:
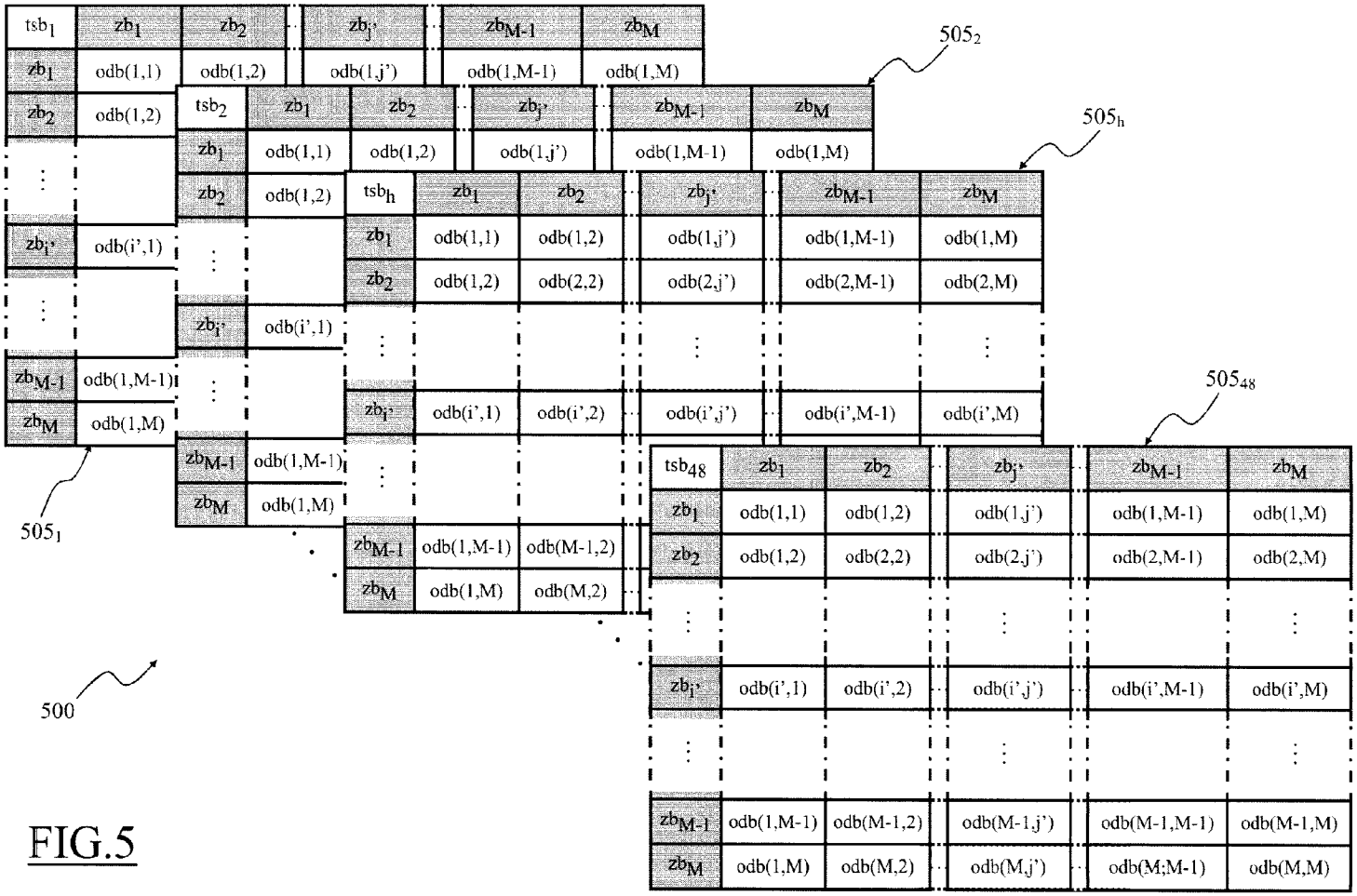
FIG. 5 shows a set of basic O-D matrices associated with the geographic area of FIG. 1 and which are computed by the system of FIG. 4 starting from collected empirical data about the movements of physical entities through such geographic area, according to an embodiment of the present invention.

Embodiments of the present invention comprise computing, starting from the collected empirical data, a base set 500 of elementary or basic O-D matrices $\mathbf{505}_h$ (with h=1, . . . , H; where H is an integer number, and H≥K, i.e. equal to or greater than the number of time slot $ts_1$-$ts_7$), shown in FIG. 5.

In other words, in order to compute the base set 500 of basic O-D matrices $\mathbf{505}_h$, the observation period during which the empirical data have been collected is advantageously subdivided into a number of elementary or basic time slots which is at least equal to, preferably greater than the number of time slots that the user of the system 400 is allowed to set for the computation of the set 300 of O-D matrices $\mathbf{200}_k$. This is to say that the observation period during which the empirical data have been collected is subdivided into a plurality of basic time slots $tsb_h$ that advantageously have a finer granularity in time, being shorter than (or at most equal to) the time slots $ts_k$ that the user of the system 400 is allowed to set. For example, the considered 24 hours observation period may be subdivided into 48 basic time slots $tsb_1$, . . . , $tsb_{48}$, each of which is 30 minutes long, instead of the exemplary seven time slots $ts_k$ described in the foregoing (even though embodiments of the present invention having basic time slots of unequal duration are not excluded).

Similarly to time slots $ts_k$, each basic time slot $tsb_h$ ranges from an initial instant $t_0(h)$ to a next instant $t_0(h+1)$ (excluded), which is the initial instant of the next basic time slot $tsb_{h+1}$, or:

$$tsb_h=[t_0(h),\ t_0(h+1)).$$

Anyway, embodiments of the present invention featuring overlapping basic time slots are not excluded.

Figure 6:
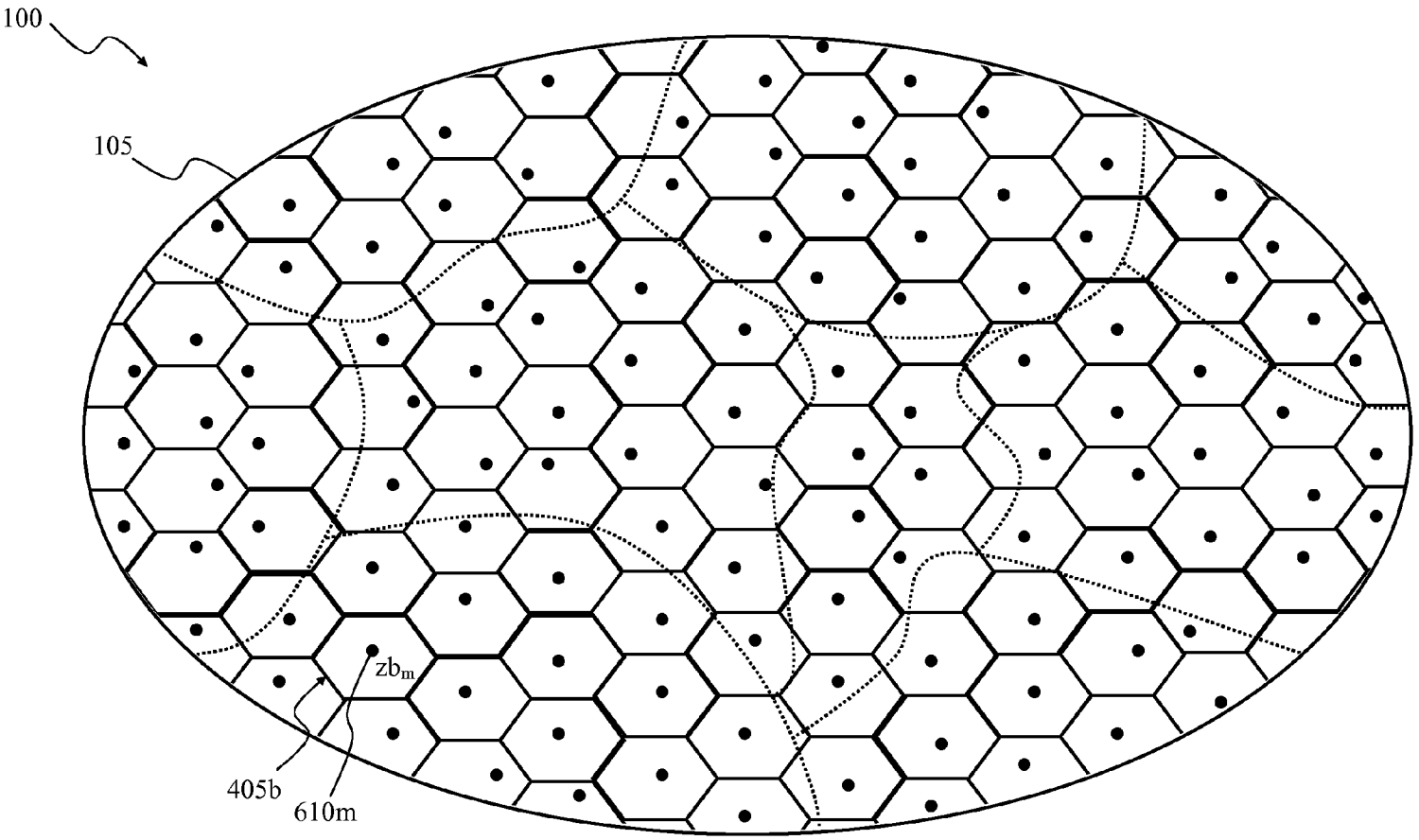
FIG. 6 is a schematic view of the geographic area of FIG. 1 subdivided into basic zones, according to an embodiment of the present invention.

Advantageously, as visible in FIG. 6, the area of interest 100 is subdivided into a plurality of M (where M is an integer number, and M≥N) elementary or basic zones $zb_m$ (m=1, . . . , M) which are smaller than—or at most equal to—the zones $z_n$ that the user of the system 400 is allowed to set for the computation of the set 300 of O-D matrices $\mathbf{200}_k$. In FIG. 6, the exemplary partitioning into zones $z_n$ shown in FIG. 1 is depicted by dotted lines. In other words, the area of interest is subdivided into a number of basic zones $zb_m$ that is at least equal, but preferably higher than the number of zones $z_n$ that (as shown in FIG. 1) the user of the system 400 is allowed to set for the computation of the set 300 of O-D matrices $\mathbf{200}_k$.

Each basic zone $zb_m$ has a corresponding centroid $\mathbf{610}_m$. For example, each basic zone $zb_m$ may be selected to be substantially equal to a cell 405*b* of the mobile network 405 (i.e., the area of interest 100 comprises M mobile network cells 405*b*).

The base set 500 of basic O-D matrices $\mathbf{505}_h$ comprises one basic O-D matrix $\mathbf{505}_h$ for each basic time slot $tsb_h$ into which the observation period has been subdivided. In the example at issue, the base set 500 comprises 48 basic O-D matrices $\mathbf{505}_1, \ldots, \mathbf{505}_{48}$.

Similarly to the O-D matrices $\mathbf{200}_k$, the generic basic O-D matrix $\mathbf{505}_h$ is a square matrix having M rows i' and M columns j'. Each row i' and each column j' is associated with a corresponding basic zone $zb_i$ of the area of interest 100. Each row i' represent a basic origin zone $zb_{i'}$, while each column j' represent a basic destination zone $zb_{j'}$ for traffic flows of moving physical entities. In other words, each basic entry $odb_{(i',j')}$ of the basic O-D matrices $\mathbf{505}_h$ represent the number of traffic flows started in the basic zone $zb_{i'}$ (origin) and ended in the basic zone $zb_{j'}$ (destination). Similarly to the O-D matrices $\mathbf{200}_k$, each basic entry $odb_{(i',j')}$ having i'=j', i.e. basic entries on the main diagonal of the generic basic O-D matrix $\mathbf{505}_h$ (relating to the same zone $zb_m$ both as origin and as destination) is considered void of any value (for the same reasons explained above).

Advantageously, the generic basic O-D matrix $\mathbf{505}_h$ has a generally finer granularity (or resolution), in term of size and number of the zones into which the area of interest 100 is subdivided, than the generic O-D matrix $\mathbf{200}_k$ that will be computed by the system 400 based on the parameters inputted by the user (since M≥N), i.e. the size of the basic zones $zb_m$ (m=1, . . . , M) is smaller than—or at most equal to—the size of the zones $z_n$ that the user of the system 400 is allowed to set for the computation of the set 300 of O-D matrices $\mathbf{200}_k$. The base set 500 also has a generally finer granularity, in term of subdivision of the observation period into time slots, than the set 300 of O-D matrices $\mathbf{200}_k$ that will be computed by the system 400 based on the parameters inputted by the user (since H≥K), i.e. the basic time slots $tsb_h$ to which each O-D matrix $\mathbf{505}_h$ of the base set 500 corresponds are shorter than (or at most equal to) the time slots $ts_k$.

The computation of the base set 500 of basic matrices $\mathbf{505}_h$—once the parameters for partitioning the area of interest 100 and the observation period are determined—may be performed in any known manner, without departing from the scope of the present invention. For example, the empirical data needed for computing the basic O-D matrices $\mathbf{505}_h$ may be collected and processed by means of procedures similar to those proposed in F. Calabrese et al. "Estimating Origin-Destination Flows Using Mobile Phone Location Data", IEEE Pervasive, pp. 36-44, October-December 2011 (vol. 10 no. 4).

Figure 7A:
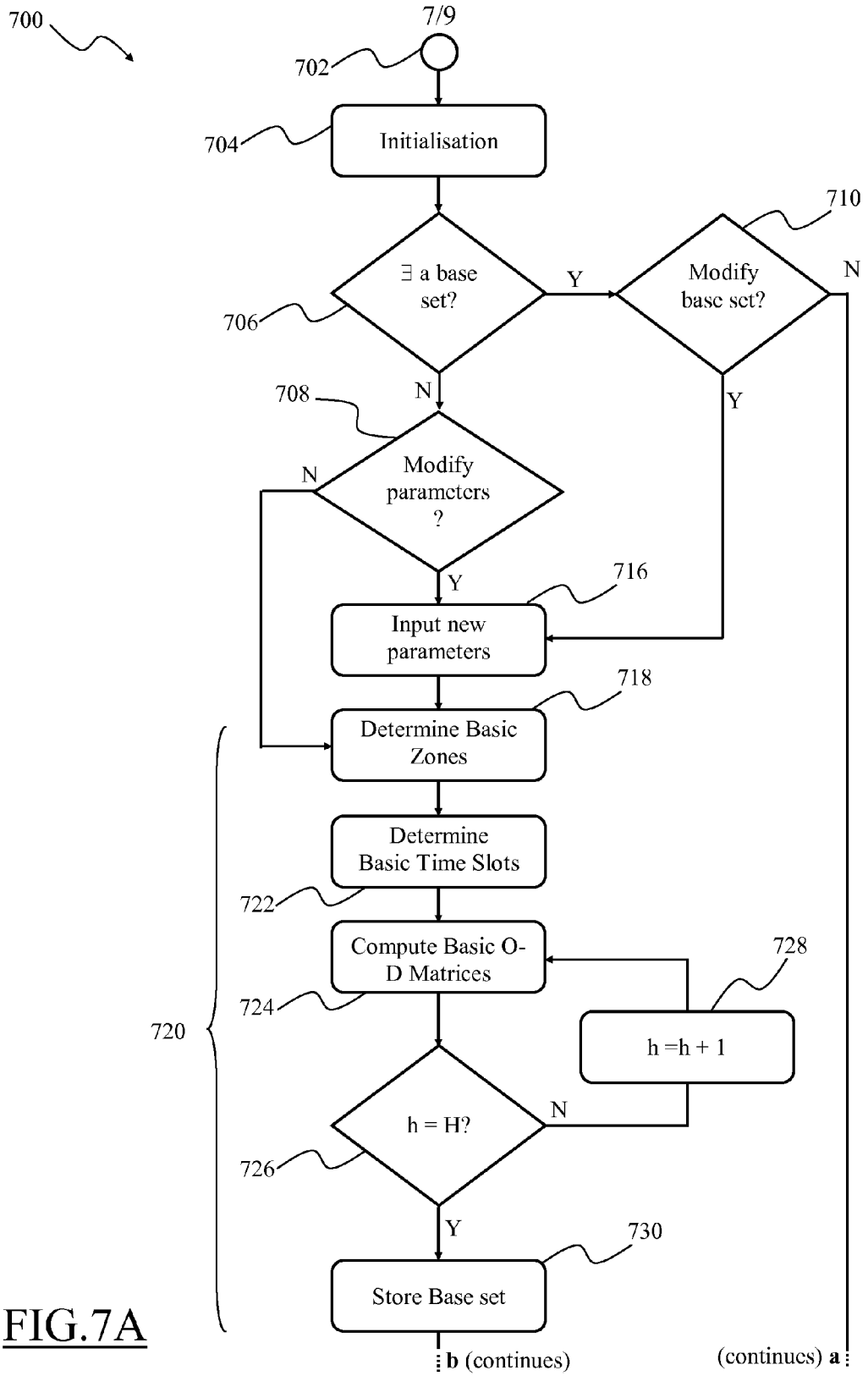
FIGS. 7A and 7B are schematic flow diagrams showing some steps of a method for computing O-D matrices according to an embodiment of the present invention.
Figure 7B:
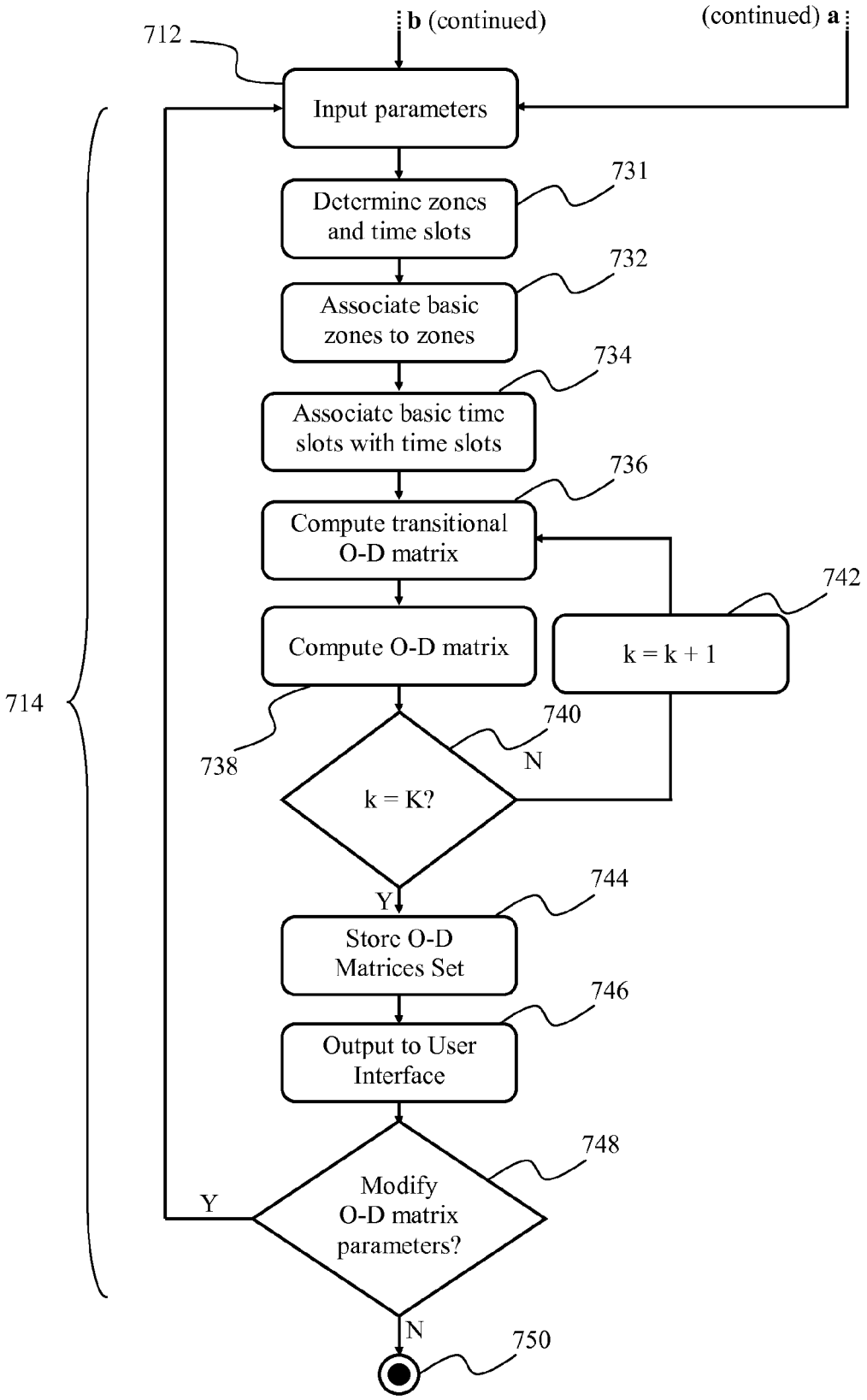

Hereafter, referring jointly to the schematic flow diagrams shown in FIGS. 7A and 7B, some steps of a method 700 according to an embodiment of the present invention implemented by the system 400 for computing a desired set 300 of O-D matrices 200 will be described.

The method 700 starts at block 702, upon activation by the system 400 (e.g., in response to a user request performed through the user interface 420, or automatically when all the traffic data in respect of an observation period have been collected) and the initialization of the system 400 is performed at block 704, in which both a basic time slots counter ch and an O-D matrix counter ck are set to one (i.e., ch=1, ck=1). The counters ch and ck may be implemented either by hardware or by software (e.g., comprised in the computation engine 410).

Then, at block 706 the presence in the repository 415 of a base set 500 of basic matrices $\mathbf{505}_h$ is verified. In the negative case, i.e. if no base set 500 exists in the repository, the method descends at block 708, whereas in the affirmative case, i.e. if a base set 500 already exists in the repository, the method passes to block 710 in which the user is asked if she/he desires to input new parameters for the computation of a new base set 500 of basic O-D matrices $\mathbf{505}_h$, modified with respect to the already existing base set 500. In the negative case (i.e., if the user does not want to modify the already existing base set 500), the method 700 passes to block 712, first step of a O-D matrices computation group 714 of steps adapted to compute the set 300 of O-D matrices $\mathbf{200}_k$ based on the existing set 500 of basic matrices $\mathbf{505}_h$. In the affirmative case, the method descends at block 716.

Back to block 708, the user is asked if she/he desires to modify the basic zones $zb_m$ and/or the basic time slots $tsb_h$ with respect to e.g. default system settings, for example stored in the repository 415 (the user can do so by inputting parameters that are used to define different basic zones $zb_m$ and/or different basic time slots $tsb_h$, different from default basic zones $zb_m$ and default basic time slots $tsb_h$) used in the computation of the basic matrices $\mathbf{505}_h$.

In the negative case, i.e. in case the user does not want to modify the basic zones $zb_m$ and/or the basic time slots $tsb_h$, the method 700 skips to block 718, first step of a basic matrices computation group 720 of steps adapted to compute the base set 500 of O-D matrices $\mathbf{505}_h$. In the affirmative case, i.e. in case the user do want to modify the basic zones $zb_m$ and/or the basic time slots $tsb_h$, the method 700 proceeds to block 716, in which the user is asked to input (e.g., through the user interface 420) new parameters for the computation of the basic O-D matrices $\mathbf{505}_h$ and descends to the basic matrix computation group 720.

For example, the basic time slots $tsb_h$ may be defined through the input interface 420 by a user, which may input the number H of basic time slots $tsb_h$ and the boundaries (i.e., $t_0(h)$, $t_0(h+1)$) thereof, or let the computation engine 410 subdivide the observation period p (i.e., 24 hours) into equal-duration basic time slots $tsb_h$, or, conversely, the user may define a time duration for the basic time slots $tsb_h$ and let the computation engine 410 define the number H of basic time slots $tsb_h$. When the user inputs boundaries for the basic time slots $tsb_h$ he/she may also choose that some or all adjacent basic time slots $tsb_h$ overlap one another.

In addition or in alternative, also the basic zones $zb_m$ may be defined through the user interface 420 by a user, for example by inputting geospatial vector data (e.g., in shapefile, kml, or kmz formats) in which each basic zone $zb_m$ is defined by means of geographic coordinates of vertexes of a corresponding polygon. The user may for example input geospatial vector data defining the cells 405*b* of the mobile telephony network 405 or geospatial vector data in which one or more groups of the cells 405*b* are aggregated (i.e., if a coarser granularity is sufficient for the basic zones $zb_m$).

At block 718 the first step of the basic matrix computation group 720 of steps is performed, which comprises subdividing the area of interest 100 into basic zones $zb_m$ according to the parameters inputted by the user (at block 716) or according to default system settings. For example, the system 400 may be adapted to associate each basic zone $zb_m$ with a corresponding one of the network cells 405*b* of the mobile network 405 deployed in the area of interest 100.

The method 700 proceeds to block 722 (second step of the basic matrix computation group 720), in which the observation period is subdivided into basic time slots $tsb_h$, according to parameters inputted by the user (at block 716) or according to default system settings. The subdivision of the observation period can be carried out by means of any suitable algorithm.

Then, at block 724 (third step of the basic matrix computation group 720) the computation engine 410 computes, one at each iteration, the basic O-D matrices $\mathbf{505}_h$ of the base set 500, which are associated with the respective basic time slots $tsb_h$.

The control of the iteration of block 724 is made at block 726 (fourth step of the basic matrix computation group 720), where it is verified if the basic time slots counter ch has reached the value H (ch=H, i.e. all the basic O-D matrices $\mathbf{505}_h$ of the set 500 have been computed). If not, the basic time slots counter ch is increased by 1 (i.e., ch=ch+1) at step 728, and the method 700 returns to block 724, so as to compute another basic O-D matrix $\mathbf{505}_h$ of the set 500.

When the basic time slots counter ch has reached the value H, all the basic O-D matrices $\mathbf{505}_h$ have been computed, and the method 700 stores (e.g., in the repository 415) the just computed base set 500 of basic O-D matrices $\mathbf{505}_h$ at block 730 (sixth step of the basic group 720), and descends to the O-D matrices computation group 714 of steps.

At block 712 the first step of the O-D matrices computation group 714 of steps is performed, which comprises asking to the user of the system 400 to input parameters for the definition of the zones $z_n$ and of the time slots $ts_k$ that will be used for the computation of the set 300 of O-D matrices $\mathbf{200}_k$ starting from the stored base set 500 of basic O-D matrices $\mathbf{505}_h$. The user may also be asked to choose an algorithm (e.g., out of a number of possible algorithms stored in the repository 415). For example, the user can manually define (e.g., through the user interface 420), at least partially, such zones $z_n$ and time slots $ts_k$. Advantageously, the zones $z_n$ and time slots $ts_k$ are defined in a way similar to that described earlier in connection with basic time slots $tsb_h$ and basic zones $zb_m$. In other words, time slots $ts_k$ may be defined by means of a time duration and/or boundaries (i.e., $t_0(k)$ and $t_0(k+1)$) thereof, while zones $z_n$ may be defined by means of geospatial vector data.

At block 731, the zones $z_n$ and time slots $ts_k$ are defined.

The method 700 descends to block 732, in which subsets of M' basic zones $zb_m$ ($1 \le M' \le M$) are associated with respective zones $z_n$ of the area of interest 100, each one of the zones $z_n$ including a respective one of such subsets of M' basic zones $zb_m$. The criteria used for associating a number of basic zones $zb_m$ with a respective zone $z_n$ may widely vary and should not considered as limiting for the present invention. For example, a basic zone $zb_m$ may be associated with a corresponding zone $z_n$ if the centroid $\mathbf{610}_m$ of the basic zone $zb_m$ is comprised in the area of the zone $z_n$; alternatively, a basic zone $zb_m$ may be associated with a zone $z_n$ if the at least half of the area of the basic zone $zb_m$ is comprised in the area of the zone $z_n$.

Next, at block 734, groups of H' basic time slots $tsb_h$ comprised in respective time slots $ts_k$ are selected ($1 \le H' \le H$). For example, with respect to the time slot $ts_4$=[12:00, 14:00), the following four basic time slots $tsb_{25}$=[12:00, 12:30), $tsb_{26}$=[12:30, 13:00), $tsb_{27}$=[13:00, 13:30) and $tsb_{28}$=[13:30, 14:00) are selected.

Figure 8:
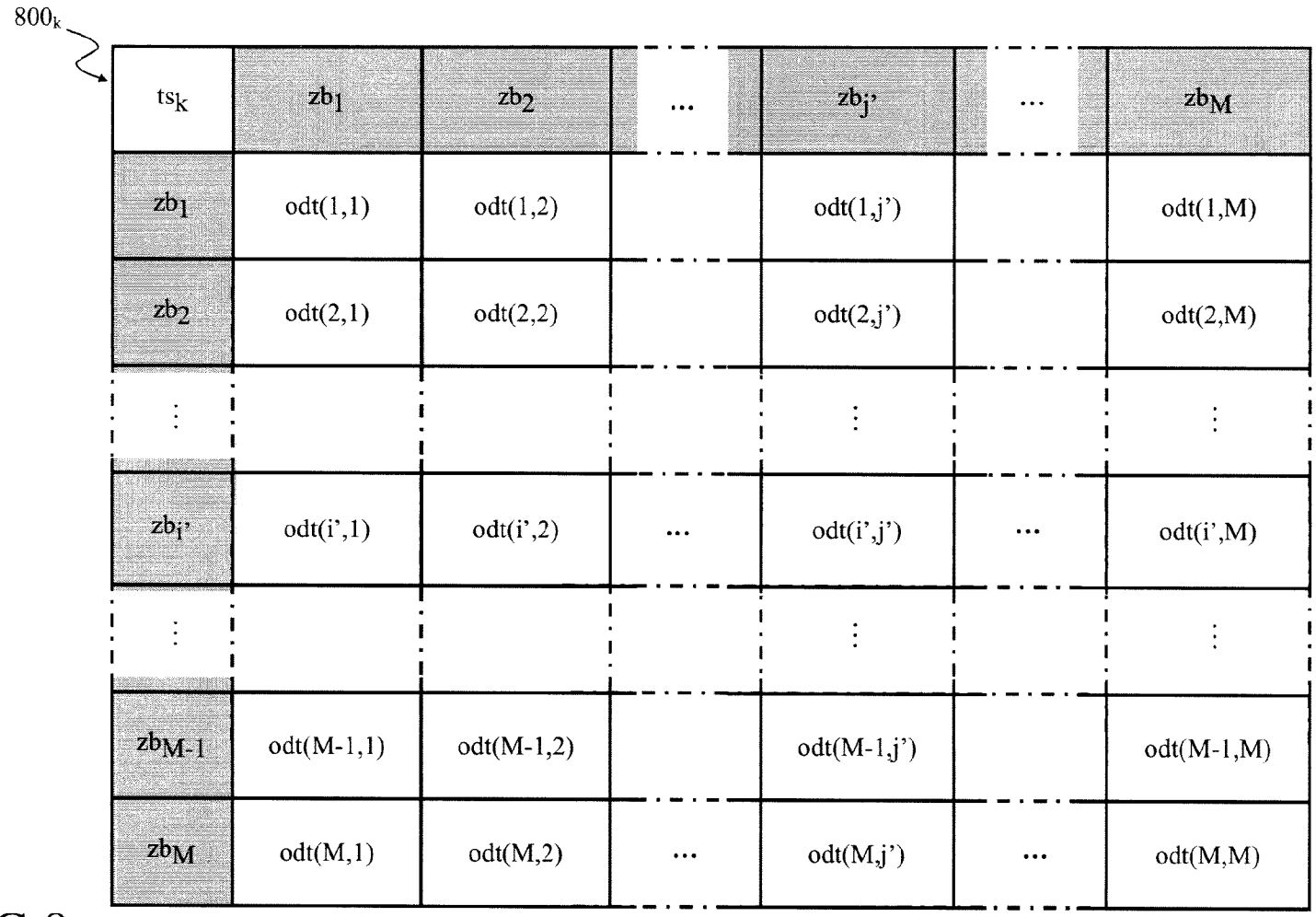
FIG. 8 is a transitional O-D matrix computed starting from the basic O-D matrices of FIG. 5, according to an embodiment of the present invention.

At the next block 736, a generic transitional O-D matrix $\mathbf{800}_k$, shown in FIG. 8, is computed by combining together a subset of basic O-D matrices $\mathbf{505}_h$ that relate to the groups of H' basic time slots $tsb_h$ previously selected at block 734. The generic transitional O-D matrix $\mathbf{800}_k$ corresponds to the time slot $ts_k$ and comprises M rows i' and M columns j', where M is, as discussed in the foregoing the number of basic zones $zb_h$.

Preferably, although not limitatively, the generic transitional O-D matrix entry $odt_{(i',j')}$ of the generic transitional O-D matrix $\mathbf{800}_k$ is computed by summing together the corresponding basic entries $odb_{(i',j')}$ of each of the H' basic O-D matrices $\mathbf{505}_h$ associated with the selected H' basic time slots $tsb_h$, or:

$$odt_{(i',j')}=\Sigma odb_{(i',j');h},$$

wherein $odb_{(i',j');h}$ indicates the entry $odb_{(i',j')}$ of the basic O-D matrix $\mathbf{505}_h$.

For example, each transitional O-D matrix entry $odt_{(i',j')}$ of the transitional O-D matrix $\mathbf{800}_4$ (i.e., referred to the time slot $ts_4$) is computed by adding together the corresponding basic entries $odb_{(i',j');25}$, $odb_{(i',j');26}$, $odb_{(i',j');27}$ and $odb_{(i',j');28}$ (i.e., $odt_{(i',j')}=odb_{(i',j');25}+odb_{(i',j');26}+odb_{(i',j');27}+odb_{(i',j');28}$) of the basic O-D matrices $\mathbf{505}_{25}$, $\mathbf{505}_{26}$, $\mathbf{505}_{27}$ and $\mathbf{505}_{28}$.

At the next block 738, the computation engine 410 computes one O-D matrix $\mathbf{200}_k$ of the set 300 of O-D matrices. The computation engine 410 combines together a subset of M' rows i' of the calculated transitional O-D matrix $\mathbf{800}_k$ obtaining one corresponding row i of the corresponding O-D matrix $\mathbf{200}_k$, and combines a subset of M' columns j' of the calculated transitional O-D matrix $\mathbf{800}_k$ obtaining one corresponding column j of the corresponding O-D matrix $\mathbf{200}_k$. In other words, an entry $od_{(i,j)}$ belonging to the row i and column j of the O-D matrix $\mathbf{200}_k$, wherein said entry $od_{(i,j)}$ is referred to the origin zone $z_i$ and to the destination zone j, results from the combination of a subset of M' entries $odb_{(i',j')}$ in the rows i' of the transitional O-D matrix $\mathbf{800}_k$, referred to the basic zones $zb_{i'}$ comprised in the zone $z_i$ and from the combination of a subset of M' entries $odb_{(i',j')}$ in columns j' referred to the basic zones $zb_{j'}$ comprised in the zone $z_j$.

For example, the generic entry $od_{(i,j)}$ of the computed O-D matrix $\mathbf{200}_k$ may be calculated as the sum of the corresponding M' transitional O-D matrix entries $odt_{(i',j')}$ referred to the sets of basic origin and destination zones $zb_{i'}$ and $zb_{j'}$, respectively comprised in the respective origin and destination zones $z_i$ and $z_j$, respectively, or:

$$od_{(i,j)}=\Sigma_{i'=1}^{M'}\Sigma_{j'=1}^{M'}odt_{(i',j')}.$$

The generic O-D matrix $\mathbf{200}_k$ is thus computed.

Nothing prevents from computing a set of alternative transitional O-D matrices (not shown), for example one transitional O-D matrix for each basic time slot $tsb_h$, having entries corresponding to the zones $z_n$, by combining a subset of M' entries $odb_{(i',j')}$ in rows i' referred to the origin basic zones $zb_{i'}$ comprised in the origin zone $z_i$ and in columns j' referred to the destination basic zones $zb_{j'}$ comprised in the destination zone $z_i$, or:

$$odt_{(i,j)}=\Sigma_{i'=1}^{M'}\Sigma_{j'=1}^{M'}odb_{(i',j')}.$$

Subsequently, each O-D matrix $\mathbf{200}_k$ is computed by combining a subset of alternative transitional O-D matrices referred to basic time slots $tsb_h$ comprised in the time slot $ts_k$, or:

$$od_{(i,j)}=\Sigma_{h=1}^{H'}odt_{(i,j);h},$$

wherein $odt_{(i,j);h}$ indicates the entry $odt_{(i,j)}$ of the h-th basic alternative transitional O-D matrix.

For the computation of all the O-D matrices $\mathbf{200}_k$, blocks 736 and 738 are iterated; the control of the iteration is done by using the O-D matrix counter ck, that at each iteration is increased by 1 (block 742) until it reaches the value K (ck=K, i.e. all the O-D matrices $\mathbf{200}_k$ of the set 300 have been computed) (block 740).

When all the O-D matrices $\mathbf{200}_k$ have been calculated, at block 744 the method 700 stores (e.g., in the repository 415) the just computed set 300 of O-D matrices $\mathbf{200}_k$.

At block 746 the complete set 300 of O-D matrices $\mathbf{200}_k$ is outputted to the user interface 420. The user can exploit the set 300 of O-D matrices $\mathbf{200}_k$ for performing the traffic analysis.

Afterwards, at block 748 the user is asked if the set 300 of O-D matrices $\mathbf{200}_k$ has to be re-computed according to different parameters (i.e., if the zones $z_n$ and the time slots $ts_k$ are to be changed). In the affirmative case, the method 700 returns to block 712; on the contrary, the method 700 ends at block 750.

In other embodiments, the present invention may comprise methods featuring different steps or some steps may be performed in a different order or in parallel.

In embodiments of the present invention, the system 400 may allow the user to define just either one between the subdivision of the area of interest 100 in a corresponding plurality of zones $z_n$ and the subdivision of the observation period into the plurality of time slots $ts_k$. For example, either the plurality of zones $z_n$ may be set equal to the existing plurality of basic zones $zb_m$, or the plurality time slots $ts_k$ may be set equal to the existing plurality of basic time slots $tsb_h$. For example, if the user chooses to subdivide the area of interest 100 into N zones $z_n$, but she/he does not define a subdivision of the observation period into K time slots $ts_k$ (K is set equal to H), the computation engine 410 will set the time slots $ts_k$ equal to the basic time slots $tsb_h$, and the computation engine 410 will compute a corresponding set of H O-D matrices of size N×N. Conversely, if the user chooses to subdivide only the time period into K time slots $ts_k$, but she/he does not define a subdivision of the area of interest 100 into N zones $z_n$ (N is set equal to M), the computation engine 410 will set the zone $z_n$ equal to the basic zones $zb_m$, and then the computation engine 410 will compute a corresponding set of K basic O-D matrices each having M×M size.

In still another embodiment of the present invention (not shown in the drawings), for example where access to the user interface 420 of the system 400 is provided to one or more subscriber users by a provider of a corresponding zoning service, the basic zones $zb_m$ and basic time slots $tsb_h$ may be fixed (e.g., they are set and/or may be modified only by an administrator of the service provider) and the subscriber users may have the capability to set and/or modify only the subdivision into zones $z_n$ and/or time slots $ts_k$. In other words, after having ascertained at block 706 the presence, in the repository 415, of a base set 500 of basic O-D matrices $\mathbf{505}_h$, the operation flow jumps directly to block 712, the first step of the O-D matrices computation group 714 of steps; if on the contrary no base set 500 of basic O-D matrices $\mathbf{505}_h$ is present in the repository 415, the operation flow jumps to block 724, where the base set 500 of basic O-D matrices $\mathbf{505}_h$ is automatically computed (i.e., according to parameters set by the system provider).

Thanks to the system 400 and/or the method 700 according to the described embodiments of the present invention, it is possible to compute a plurality of sets 300 of O-D matrices $\mathbf{200}_k$ by varying the parameters used to build the same in a very limited operation time and without the necessity of re-analyzing and re-editing the collected traffic data. It should also be appreciated that once the base set 500 of basic O-D matrices $\mathbf{505}_h$ has been computed, any other iteration of the method 700, using the already available base set 500 of basic O-D matrices $\mathbf{505}_h$, results to be very faster than the first iteration thereof (since the steps at blocks 708-728 needs not to be performed).

The invention claimed is:

1. A method, implemented by a system connected to a radio telecommunication network that includes processing circuitry, for managing data regarding one or more flows of physical entities in a geographic area during at least one predetermined time period, the method comprising the following steps performed by the processing circuitry:

receiving, from the radio telecommunication network and for each physical entity, the data which includes a plurality of positioning data representing detected positions of the physical entity in the geographic area and corresponding time data identifying instants at which each position is detected;

subdividing the geographic area into at least two zones;

subdividing the at least one time period into one or more time slots;

identifying a number of physical entities that flowed from a first zone of the at least two zones to a second zone of the at least two zones during each time slot;

computing an Origin-Destination matrix for each time slot of the one or more time slots based on such identifying, each Origin-Destination matrix comprising a respective row for each one of the at least two zones where the flow of the physical entities may have started and a respective column for each one of the at least two zones where the flow of the physical entities may have ended during the corresponding time slot, and each entry of the Origin-Destination matrix being indicative of the number of physical entities that, during the corresponding time slot, flowed from a first zone of the at least two zones to a second zone;

subdividing the geographic area into a plurality of basic zones;

subdividing the at least one time period into a plurality of basic time slots, wherein the basic zones are smaller than the zones, and/or the basic time slots are shorter than the one or more time slots;

identifying a further number of elements flowed from a first basic zone of the plurality of basic zones to a second basic zone of the plurality of basic zones during each basic time slot;

computing a basic Origin-Destination matrix for each basic time slot on the basis of such identifying, each basic origin-destination matrix comprising a respective row for each one of the plurality of basic zones where elements flow may have started and a respective column for each one of the plurality of basic zones where elements flow may have ended during the corresponding basic time slot, and each entry of the basic Origin-Destination matrix comprises the further number of elements flowed from a first basic zone of the plurality of basic zones to a second basic zone of the plurality of basic zones; and the identifying a number of elements flowed from a first zone to a second zone during each time slot comprises:

combining together a selected subset of basic Origin-Destination matrices for each Origin-Destination matrix, and combining together selected subsets of entries in each combined subset of basic Origin-Destination matrices, or combining together selected subsets of entries in each basic Origin-Destination matrix, and combining together a selected subset of basic Origin-Destination matrices having combined selected subsets of entries for each Origin-Destination matrix, wherein the radio-telecommunication network operates over a plurality of telecommunication cells deployed in the geographic area, and the managed data regard one or more mobile telecommunication devices each mobile telecommunication device being associated with a respective one of the flowing elements, the subdividing the geographic area into a plurality of basic zones comprises:

associating each basic zone of the plurality of basic zones with at least a corresponding telecommunication cell of the radio-telecommunication network.

2. The method according to claim 1, wherein the identifying a number of elements flowed from a first zone to a second zone during for each time slot of the one or more time slots comprises:

selecting a subset of basic time slots comprised in the time slot, and selecting a subset of basic zones comprised in the zone.

3. The method according to claim 2, wherein the selecting a subset of basic zones comprised in the zone comprises:

selecting a basic zone if a selected percentage of an area of the basic zone is comprised in the zone.

4. The method according to claim 2, wherein each basic zone of the plurality of basic zones comprises a centric representing a hub for the flows of elements in the basic zone, and wherein the selecting a subset of basic zones comprised in the zone comprises:

selecting a basic zone if the centric of the basic zone is comprised in the zone.

5. The method according to claim 2, wherein the combining together a selected subset of basic Origin-Destination matrices for each Origin-Destination matrix comprises:

computing a transitional Origin-Destination matrix for each time slot by combining a subset of basic Origin-Destination matrices, each corresponding to a selected basic time slot of the selected subset of basic time slots, each transitional Origin-Destination matrix comprising a respective row for each one of the plurality of basic zones where elements flow may have started and a respective column for each one of the plurality of basic zones where elements flow may have ended during the corresponding time slot, and each entry of the transitional Origin-Destination matrix comprises a number of elements flowed from a first basic zone of the plurality of basic zones to a second basic zone of the plurality of basic zones during the corresponding time slot.

6. The method according to claim 5, wherein the computing a Origin-Destination matrix for each time slot further comprises: combining together a subset of entries of the transitional Origin-Destination matrix, each corresponding to a selected basic zone of the subset of basic zones.

7. The method according to claim 2, wherein the combining together selected subsets of entries in each basic Origin-Destination matrix comprises:

computing a transitional Origin-Destination matrix for each basic time slot by combining a selected subsets of entries of the corresponding basic Origin-Destination matrix, each transitional Origin-Destination matrix comprising a respective row for each one of the plurality of zones where elements flow may have started and a respective column for each one of the plurality of zones where elements flow may have ended during the corresponding time slot, and each entry of the transitional Origin-Destination matrix comprises a number of elements flowed from a first zone of the at least two zones to a second zone of the at least two zones during the corresponding basic time slot.

8. The method according to claim 7, wherein the computing a Origin-Destination matrix for each time slot further comprises:

combining together a subset of transitional Origin-Destination matrix, each corresponding to a selected basic time slot of the selected subset of basic time slots.

9. The method according to claim 1, further comprising:

modifying parameters used for subdividing the geographic area into a plurality of basic zones and/or the at least one time period into a plurality of basic time slots, according to a user request; and reiterating:

subdividing the geographic area into a plurality of basic zones smaller than the zones, and/or subdividing the at least one time period into a plurality of basic time slots, the basic time slots being shorter than the time slots, according to the modified parameters, and reiterating:

identifying a further number of element flowed from a first basic zone of the plurality of basic zones to a second basic zone of the plurality of basic zones during each basic time slot, and computing a basic Origin-Destination matrix for each basic time slot on the base of such identifying.

10. The method according to claim 1, further comprising:

modifying parameters used for subdividing the geographic area into a plurality of zones and/or the at least one time period into one or more time slots, according to a user request;

reiterating:

subdividing the geographic area into at least two zones;

subdividing the at least one time period into a one or more time slots;

identifying a number of elements flowed from a first zone of the at least two zones to a second zone of the at least two zones during each time slot; and computing an Origin-Destination matrix for each time slot of the one or more time slots on the base of such identifying.

11. A system for managing data regarding one or more flows of elements in a geographic area during at least one predetermined time period, wherein a radio-telecommunication network subdivided into a plurality of telecommunication cells is deployed in the geographic area, the system comprising:

processing circuitry configured to receive, from the radio telecommunication network and for each physical entity, the data which includes a plurality of positioning data representing detected positions of the physical entity in the geographic area and corresponding time data identifying instants at which each position is detected, subdivide the geographic area into at least two zones;

subdivide the at least one time period into one or more time slots;

identify a number of physical entities that flowed from a first zone of the at least two zones to a second zone of the at least two zones during each time slot;

compute an Origin-Destination matrix for each time slot of the one or more time slots based on such identifying, each Origin-Destination matrix comprising a respective row for each one of the at least two zones where the flow of the physical entities may have started and a respective column for each one of the at least two zones where the flow of the physical entities may have ended during the corresponding time slot, and each entry of the Origin-Destination matrix being indicative of the number of physical entities that, during the corresponding time slot, flowed from a first zone of the at least two zones to a second zone;

subdivide the geographic area into a plurality of basic zones;

subdivide the at least one time period into a plurality of basic time slots, wherein the basic zones are smaller than the zones, and/or the basic time slots are shorter than the one or more time slots;

identify a further number of elements flowed from a first basic zone of the plurality of basic zones to a second basic zone of the plurality of basic zones during each basic time slot; and compute a basic Origin-Destination matrix for each basic time slot on the basis of such identifying, each basic origin-destination matrix comprising a respective row for each one of the plurality of basic zones where elements flow may have started and a respective column for each one of the plurality of basic zones where elements flow may have ended during the corresponding basic time slot, and each entry of the basic Origin-Destination matrix comprises the further number of elements flowed from a first basic zone of the plurality of basic zones to a second basic zone of the plurality of basic zones, wherein the processing circuitry identifies the number of elements flowed from a first zone to a second zone during each time slot by:

combining together a selected subset of basic Origin-Destination matrices for each Origin-Destination matrix, and combining together selected subsets of entries in each combined subset of basic Origin-Destination matrices, or combining together selected subsets of entries in each basic Origin- Destination matrix, and combining together a selected subset of basic Origin-Destination matrices having combined selected subsets of entries for each Origin-Destination matrix, and wherein the managed data regard one or more mobile telecommunication devices each mobile telecommunication device being associated with a respective one of the flowing elements, and the processing circuitry subdivides the geographic area into a plurality of basic zones by associating each basic zone of the plurality of basic zones with at least a corresponding telecommunication cell of the radio-telecommunication network.

12. The system according to claim 11, further comprising a memory configured to store the each computed basic Origin-Destination matrix.

13. The system according to claim 11, further comprising at least one user interface configured to output information to, and receiving inputs information from, at least one user.

14. The system according to claim 11, further configured to collect data regarding a plurality of mobile telecommunication devices comprised in the area of interest, each mobile telecommunication device being associated with a respective one of the flowing elements in the area of interest.

* * * * *